US008894515B2

(12) United States Patent
Mansfield

(10) Patent No.: US 8,894,515 B2
(45) Date of Patent: Nov. 25, 2014

(54) NETTING SYSTEM FOR DRINKING GAMES

(76) Inventor: Andrew Mansfield, Salem, MA (US)

( * ) Notice: Subject to any disclaimer, the term of this patent is extended or adjusted under 35 U.S.C. 154(b) by 718 days.

(21) Appl. No.: 13/235,381

(22) Filed: Sep. 17, 2011

(65) Prior Publication Data

US 2012/0071278 A1 Mar. 22, 2012

Related U.S. Application Data

(60) Provisional application No. 61/383,753, filed on Sep. 17, 2010.

(51) Int. Cl.
*A63B 71/00* (2006.01)
*A63B 71/02* (2006.01)

(52) U.S. Cl.
CPC ..... *A63B 71/022* (2013.01); *A63B 2243/0091* (2013.01)
USPC ..... 473/475; 473/496

(58) Field of Classification Search
USPC ..... 473/421, 473–475, 496, 491, 415, 459, 473/460
See application file for complete search history.

(56) References Cited

U.S. PATENT DOCUMENTS

| | | | | | |
|---|---|---|---|---|---|
| 1,553,682 | A * | 9/1925 | Froud et al. | ..... | 273/317 |
| 2,127,873 | A * | 8/1938 | Le Guillou | ..... | 473/475 |
| 2,313,701 | A * | 3/1943 | White | ..... | 473/475 |
| 4,037,838 | A * | 7/1977 | McCune | ..... | 273/317 |
| 5,383,658 | A * | 1/1995 | Newgarden, Jr. | ..... | 473/475 |
| 5,566,936 | A * | 10/1996 | Newgarden et al. | ..... | 473/475 |
| 6,379,272 | B1 * | 4/2002 | Gorgo et al. | ..... | 473/421 |
| 8,210,968 | B2 * | 7/2012 | Chen | ..... | 473/433 |
| 2012/0071278 | A1 * | 3/2012 | Mansfield | ..... | 473/421 |
| 2012/0100937 | A1 * | 4/2012 | Chen | ..... | 473/433 |

* cited by examiner

*Primary Examiner* — Raleigh W Chiu
(74) *Attorney, Agent, or Firm* — Daniel N. Smith

(57) ABSTRACT

An accessory for the game of beer pong and related games. The accessory includes two separate net assemblies that attach to both ends of a beer pong table. The netting assembly catches ping-pong balls that go over the edges of the game table during game play to prevent the ping pong balls from touching the floor. This netting system will reduce the amount of dirt and contamination on the ping pong balls, which will reduce the amount of dirt and contamination dirty ping pong balls spread to beverages containers used in game play.

20 Claims, 3 Drawing Sheets

NETTING SYSTEM FOR DRINKING GAMES

CROSS REFERENCE TO RELATED APPLICATION

This application claims the benefit of U.S. Provisional Patent Application No. 61/383,753 filed on Sep. 17, 2010, the contents of which are incorporated herein by reference.

FIELD OF THE INVENTION

The field of the invention relates to a netting system for attachment to tables used in beer pong, and related games. The netting system catches ping-pong balls that go over the edges of the table during game play. This netting system will reduce contact between the ping pong balls and the surrounding floor, reducing the amount of dirt and contamination on the ping pong balls. Cleaner ping pong balls will reduce the amount of dirt and contamination spread to beverages containers used in game play.

BACKGROUND OF INVENTION

Beer pong is a drinking game that has risen in popularity in recent years.

Beer pong is played in basically two versions, beer pong played by hand, also known as "Beirut", and beer pong played with paddles. While both of these versions have a wide variety of rules, the basic set up of the game consists of two (2) teams of two-to-four-player each on opposing sides of a flat table. The game may be played on any suitable flat surface, but the preferred playing surfaces are rectangular tables, such as door, dining, folding banquet tables or boards cut in a rectangular shape. Various table sizes are usually 2 to 4 feet in width, 7 to 10 feet in length and 2.5 to 4 feet in height.

On both edges of the game table, cups are placed in one of many various formations in front of each team. The triangle formation is usually the most popular. Each of these cups contains a beverage, usually beer or water (water pong), however, other beverages, such as cocktails (tails pong) and champagne (champong), have started to emerge in use.

Game play consists of each team taking alternating turns to throw or paddle 38 mm or 40 mm table tennis (ping pong) balls across the table, from behind their respective cup formations, with the intent of landing the ball into one of the opposing team's cups.

Once a team lands a ping pong ball into an opposing team's cup, one member of that opposing team must usually drink the beverage contained within the cup and remove the cup from their formation. The game is lost by the first team that drinks and removes all their cups from the table.

The version of beer pong played with paddles usually results in much less ping pong balls landing in the cups (known as a "sink" in that version of the game).

During game play, many ping pong balls miss the cups or ricochet off cups, the table or other players onto the surrounding floor. This floor may be dirty and filled with contaminants. Since these dirty ping pong balls will likely come into contact with a beverage to be consumed during remaining game play, each team usually has a separate cup of water, known as a "wash cup", to rinse off a ping pong ball after it hits the floor.

This method of cleaning the ping pong balls is inefficient and often ineffective as the wash cups become dirty and contaminated from repeated contact with dirty ping pong balls as the game progresses. In addition, research has shown that the wash cups still hold bacteria, such as *E. coli*. The supposed cleaning effects of the wash cup may be offset by the presence of bacteria.

Previous solutions to this problem include changing the wash cup frequently during game play with a fresh cup and water or changing ping pong balls that have hit the floor with new balls. These solutions substantially slow down game play and require many fresh ping pong balls to be effective. Another solution is for players to drink from beverage containers other than the cups used in game play. This solution creates uncertainly in the amounts consumed during game play and requires players to keep additional beverage containers close to the game table.

Accordingly, a need exists for a cheap, easy to manufacture and an easy to use system that prevents ping pong balls from hitting the surrounding floor during game play. This system should be easy and quick to install over the variety of tables used in game play. The system should be easy to remove and clean.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The subject invention discloses an accessory for use with a beer pong table having a substantially horizontal playing surface, wherein the accessory comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention further discloses a catch-net assembly for use with a beer pong table having a substantially horizontal playing surface, wherein the catch-net assembly comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention also discloses a beer pong game accessory apparatus for use with a beer pong table having a substantially horizontal playing surface, wherein the game accessory apparatus comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention discloses a netting system for use with a beer pong table having a substantially horizontal playing surface, wherein the netting system comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention also discloses an accessory for use with the game of beer pong, wherein the accessory comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod member; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention further discloses a catch-net assembly for use with the game of beer pong, wherein the catch-net assembly comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention also discloses a netting system for use with the game of beer pong, wherein the netting system comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention discloses an accessory for use with a beer pong table having a substantially horizontal playing surface, wherein the accessory comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention further discloses a catch-net assembly for use with a beer pong table having a substantially horizontal playing surface, wherein the catch-net assembly comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention also discloses a beer pong game accessory apparatus for use with a beer pong table having a substantially horizontal playing surface, wherein the game accessory apparatus comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention further discloses a netting system for use with a beer pong table having a substantially horizontal playing surface, wherein the netting system comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention also discloses an accessory for use with the game of beer pong, wherein the accessory comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention further discloses a catch-net assembly for use with the game of beer pong, wherein the catch-net assembly comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention also discloses a netting system for use with the game of beer pong, wherein the netting system comprises: a first plurality of clamps detachably mounted to a first latitudinal side edge of the beer pong table, wherein the first plurality of clamps extends outward in a substantially perpendicular direction from the first latitudinal side edge; a first set of at least two elongated resilient tubular members with an internal lumen; a first means for removably attaching proximal ends of the first set of tubular members to the first plurality of clamps such that the first set of tubular members extend outward from the first latitudinal side edge; a first elongated net removably mounted to the top surface of the first set of tubular members, wherein the first elongated net extends the width of the first latitudinal side edge, further wherein the plurality of openings in the first elongated net are dimensioned to prevent 38 to 40 mm diameter table tennis balls from passing through the first elongated net; a second plurality of clamps detachably mounted to a second latitudinal side edge of the beer pong table, wherein the second plurality of clamps extends outward in a substantially perpendicular direction from the second latitudinal side edge; a second set of at least two elongated resilient tubular members with an internal lumen; a second means for removably attaching proximal ends of the second set of tubular members to the second plurality of clamps such that the second set of tubular members extend outward from the second latitudinal side edge; and a second elongated net removably mounted to the top surface of the second set of tubular members, wherein the second elongated net extends the width of the second latitudinal side edge, further wherein the plurality of openings in the second elongated net are dimensioned to prevent 38 to 40 mm diameter table tennis balls from passing through the second elongated net.

The subject invention discloses a catch-net assembly for use with a beer pong table having a substantially horizontal playing surface, wherein the catch-net assembly comprises: a first support member detachably mounted to a first latitudinal side edge of the playing surface of the beer pong table, wherein the first support member extends outward in a substantially perpendicular direction from the first latitudinal side edge, a first set of at least two elongated relatively non-deformable rod members; a first means for attaching proximal ends of the first set of rod members to the first support member such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second support member detachably mounted to a second latitudinal side edge of the playing surface of the beer pong table, wherein the second support member extends outward in a substantially perpendicular direction from the second latitudinal side edge, a second set of at least two elongated relatively non-deformable rod members; a second means for attaching proximal ends of the second set of rod members to the second support member such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention further discloses a beer pong game accessory apparatus for use with a beer pong table having a substantially horizontal playing surface, wherein the game accessory apparatus comprises: a first support member detachably mounted to a first latitudinal side edge of the playing surface of the beer pong table, wherein the first support member extends outward in a substantially perpendicular direction from the first latitudinal side edge, a first set of at least two elongated relatively non-deformable rod members; a first means for attaching proximal ends of the first set of rod members to the first support member such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second support member detachably mounted to a second latitudinal side edge of the playing surface of the beer pong table, wherein the second support member extends outward in a substantially perpendicular direction from the second latitudinal side edge, a second set of at least two elongated relatively non-deformable rod members; a second means for attaching proximal ends of the second set of rod members to the second support member such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention discloses a netting system for use with a beer pong table having a substantially horizontal playing surface, wherein the netting system comprises: a first support member detachably mounted to a first latitudinal side edge of the playing surface of the beer pong table, wherein the first support member extends outward in a substantially perpendicular direction from the first latitudinal side edge, a first set of at least two elongated relatively non-deformable rod members; a first means for attaching proximal ends of the first set of rod members to the first support member such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second support member detachably mounted to a second latitudinal side edge of the playing surface of the beer pong table, wherein the second support member extends outward in a substantially perpendicular direction from the second latitudinal side edge, a second set of at least two elongated relatively non-deformable rod members; a second means for attaching proximal ends of the second set of rod members to the second support member such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention also discloses an accessory for use with the game of beer pong, wherein the accessory comprises: a first support member detachably mounted to a first latitudinal side edge of the playing surface of the beer pong table, wherein the first support member extends outward in a substantially perpendicular direction from the first latitudinal side edge, a first set of at least two elongated relatively non-deformable rod members; a first means for attaching proximal ends of the first set of rod members to the first support member such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second support member detachably mounted to a second latitudinal side edge of the playing surface of the beer pong table, wherein the second support member extends outward in a substantially perpendicular direction from the second latitudinal side edge, a second set of at least two elongated relatively non-deformable rod members; a second means for attaching proximal ends of the second set of rod members to the second support member such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention further discloses a catch-net assembly for use with the game of beer pong, wherein the catch-net assembly comprises: a first support member detachably mounted to a first latitudinal side edge of the playing surface of the beer pong table, wherein the first support member extends outward in a substantially perpendicular direction from the first latitudinal side edge, a first set of at least two elongated relatively non-deformable rod members; a first means for attaching proximal ends of the first set of rod members to the first support member such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second support member detachably mounted to a second latitudinal side edge of the playing surface of the beer pong table, wherein the second support member extends outward in a substantially perpendicular direction from the second latitudinal side edge, a second set of at least two elongated relatively non-deformable rod members; a second means for attaching proximal ends of the second set of rod members to the second support member such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

The subject invention also discloses a netting system for use with the game of beer pong, wherein the netting system comprises: a first support member detachably mounted to a first latitudinal side edge of the playing surface of the beer pong table, wherein the first support member extends outward in a substantially perpendicular direction from the first latitudinal side edge, a first set of at least two elongated relatively non-deformable rod members; a first means for attaching proximal ends of the first set of rod members to the first support member such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second support member detachably mounted to a second latitudinal side edge of the playing surface of the beer pong table, wherein the second support member extends outward in a substantially perpendicular direction from the second latitudinal side edge, a second set of at least two elongated relatively non-deformable rod members; a second means for attaching proximal ends of the second set of rod members to the second support member such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

In a further embodiments of the subject invention, the second elongated net are a mirror image of the first elongated net.

In additional embodiments of the subject invention may further comprise a first set of hollow tubular elbows that comprise at least one opening for receiving the distal ends of each of the first set of rod members and a second set of hollow tubular elbows that comprise at least one opening for receiving the distal ends of each of the second set of rod members.

Further embodiments of the subject invention may further comprise a first set of tubular inserts that are inserted into a second opening on the first set of hollow tubular elbows and a second set of tubular inserts that are inserted into a second opening on the second set of hollow tubular elbows.

In additional embodiments of the subject invention, the distal end of the hollow tubular elbows extend outward in a direction that is substantially perpendicular with the horizontal playing surface of the beer pong table.

In further embodiments of the subject invention, the distal end of the hollow tubular elbows may extend outward in a direction that is 30 to 160 degrees with respect to the horizontal playing surface of the beer pong table.

In embodiments of the subject invention may further comprise Rod members are substantially straight.

In additional embodiments of the subject invention rod or tubular members may comprise at least one bend.

In further embodiments of the subject invention, the means of attaching the mounting base members to the set of rod or tubular members is a plurality of openings in the base member that receive the proximal ends of each rod member or screw clamps or ties.

In additional embodiments of the subject invention, the set of rod members may be attached to the mounting bases member by inserting the proximal ends of each rod member into a plurality of openings in the base member, or with screw clamps or ties.

In further embodiments of the subject invention, rod or tubular members extend outward in a direction that is substantially coplanar with the horizontal playing surface of the beer pong table.

In further embodiments of the subject invention, rod or tubular members extend outward in a direction that is 1 to 30 degrees with respect to the horizontal playing surface of the beer pong table.

In additional embodiments of the subject invention, rod or tubular members extend outward in a direction that is substantially perpendicular with the latitudinal side edges.

In further embodiments of the subject invention, rod or tubular members extend outward in a direction that is 91 to 160 degrees with respect to the latitudinal side edges.

In further embodiments of the subject invention, the mounting base may comprise a plurality of clamps selected from the group consisting of magnetic clamps, squeeze clamps, bench clamps, C clamps, screw clamps, spring clamps, quick grip clamps and quick action clamps.

In further embodiments of the subject invention, the tubing or rod members, clamp, elbow and inserts may comprise a single unitary piece of material.

In additional embodiments of the subject invention, rod or tubular members may be 4" to 30" in length and ½" to 3" in diameter.

In further embodiments of the subject invention, additional tubing or rod members may be connected to the distal end of tubing or rod members.

In further embodiments of the subject invention, the rod or tubular members may comprise a traverse cross section selected from the group consisting of a shape selected from the group consisting of circular, triangular, square, hexagonal and octagonal.

In additional embodiments of the subject invention, the means for removably mounting the elongated nets to the set of rod members or the tubular members are flexible ties.

In further embodiments of the subject invention the elongated nets may comprise a material selected from the group consisting of a fabric material, a vinyl polymer, a plastic material.

In further embodiments of the subject invention, the elbows may be 2" to 20" in length and ½" to 3" in diameter.

Additional embodiments of the subject invention may further comprise elbows and inserts may comprise a traverse cross section comprising a shape selected from the group consisting of circular, triangular, square, hexagonal and octagonal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. These together with other objects of the invention, along with the various features of novelty, which characterize the invention, are pointed out with particularity in the claims annexed to and forming a part of this disclosure.

BRIEF DESCRIPTION OF THE DRAWINGS

Advantages of the present invention will be apparent from the following detailed description of exemplary embodiments thereof, which description should be considered in conjunction with the accompanying drawings.

DETAILED DESCRIPTION OF EMBODIMENTS

The following will describe, in detail, several embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

For a conceptual understanding of the invention and its operational advantages, refer to the accompanying drawings and descriptive matter in which there are preferred embodiments of the invention illustrated. Other features and advantages of the present invention will become apparent from the following description of the preferred embodiment(s), taken in conjunction with the accompanying drawings, which by way of example; illustrate the principles of the invention.

The subject invention is a netting system for assembly and attachment to tables used in beer pong, and related games, to catch ping-pong balls used in game play that go over the edges of the game table. By preventing ping pong balls from touching the floor, this netting system will reduce the amount of dirt and contamination on the ping pong balls, which will reduce the amount of dirt and contamination dirty ping pong balls spread to beverages containers used in game play.

Figure 1:
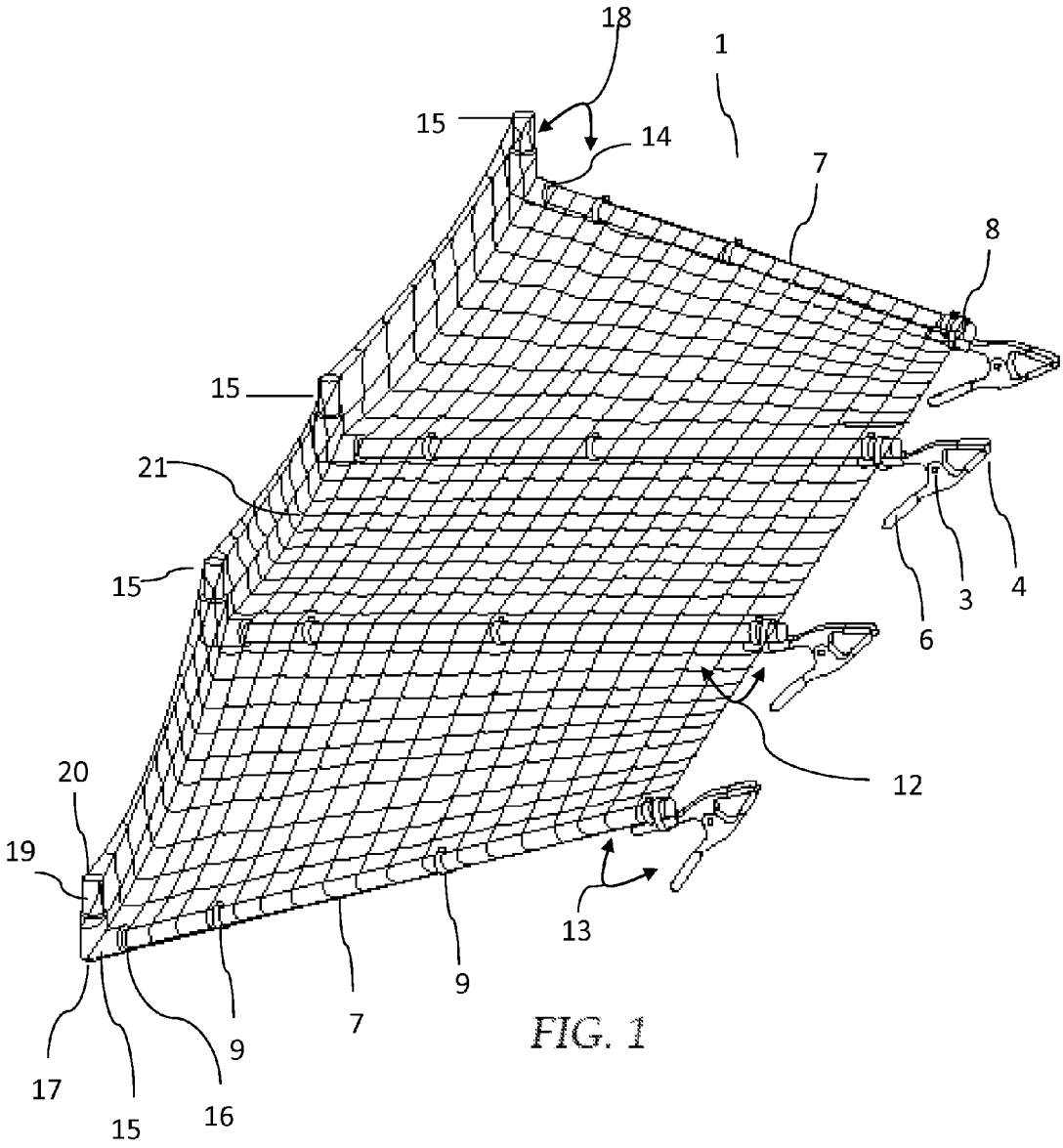
FIG. 1 illustrates an isometric view of an unattached assembled netting system for attachment on beer pong tables.
Figure 2:
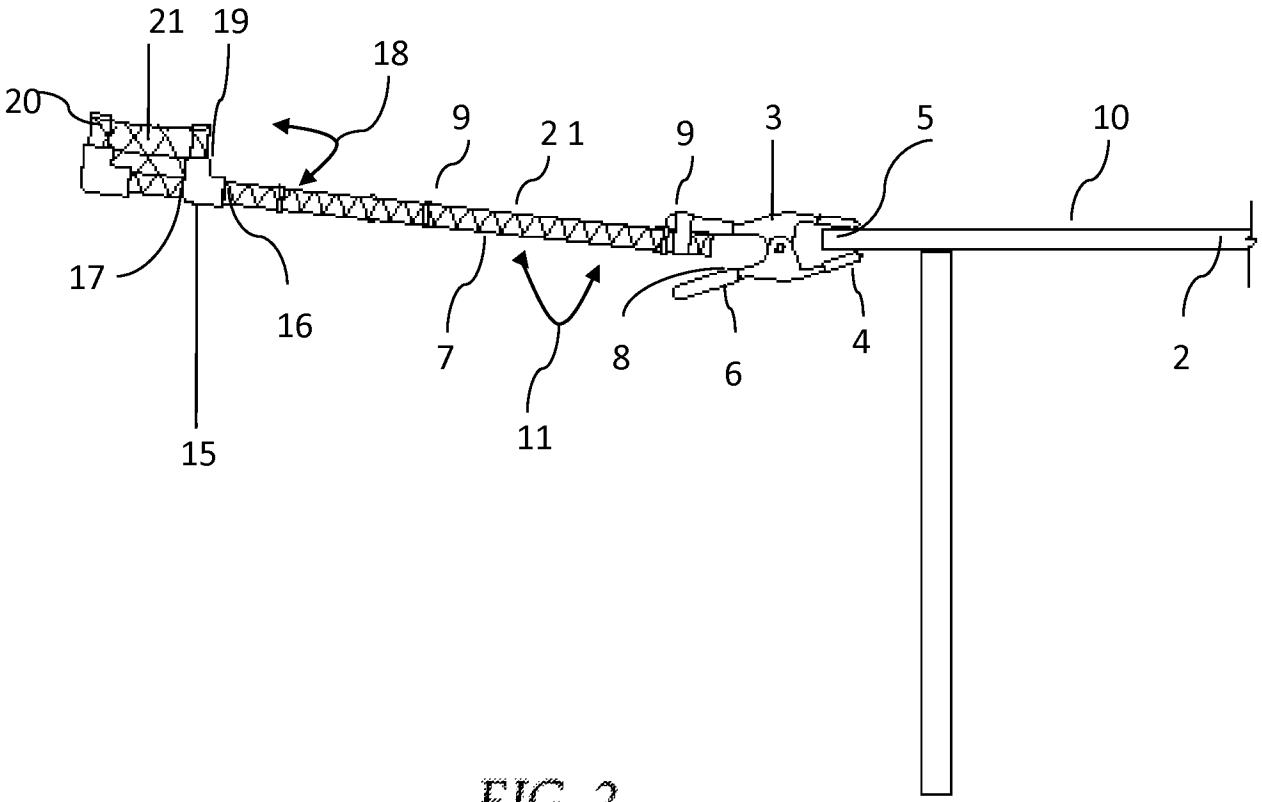
FIG. 2 illustrates a side view of an assembled netting system attached to one end of a beer pong table.
Figure 3:
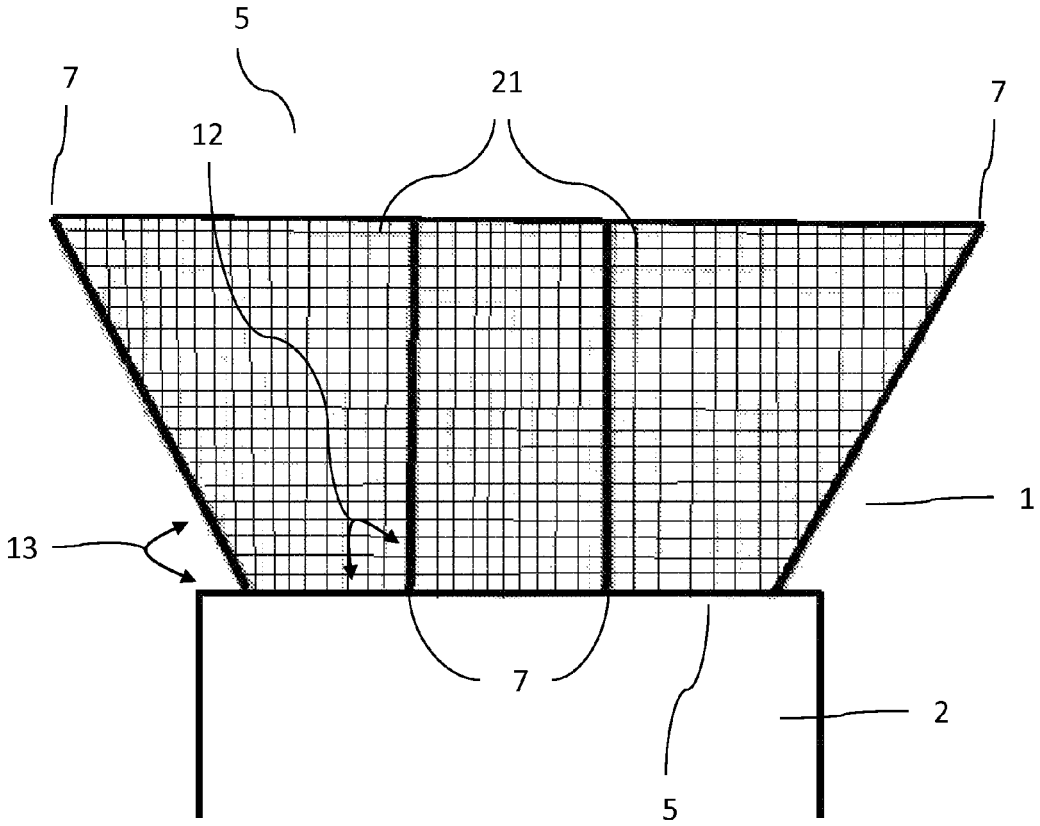
FIG. 3 illustrates a top view of an assembled netting system attached to one end of a beer pong table.

FIGS. 1 through 3 illustrate an embodiment of one end of the assembled netting system 1 for attachment on beer pong tables 2. While FIGS. 1 through 3 only illustrate one net of the netting system 1 attached to end 5 of table 2, it is understood that an additional net is attached to other end of table 2 for game play (not shown). Furthermore, for the purposes of this invention, the proximal ends of netting system 1 and its components are defined as the ends closer to table 2 and the distal ends of netting system 1 and its components are defined as the ends farther away from table 2.

Each netting system 1 comprises several clamps 3 that connect at a proximal end 4 to end 5 of table 2, as shown in FIGS. 2 and 3. In other embodiments of the subject invention, there may be two to six clamps within the netting system 1. In further embodiments of the subject invention the clamps may be squeeze clamps, bench clamps, C clamps, screw clamps, spring clamps, quick grip clamps or quick action clamps. In an additional embodiment of the subject invention, the clamps may be magnetic if the table is composed of a magnet-attracting material, such a metal. The clamps 3 are designed to attach the netting system 1 to any game-suitable flat surface, such as door, dining, folding banquet tables or boards cut in a rectangular shape.

The distal ends 6 of the clamps 3 are attached to the proximal ends 8 of tubing 7 either by screw clamps (not shown) or ties 9. As shown in FIG. 2, tubing 7 may extend away from clamps 3 in a distal direction that is substantially parallel with top 10 of table 2 as shown by angle 11. In other embodiments of the subject invention, tubing 7 may extend away from clamps 3 at an angle of 1 to 30 degrees in relation to the top 10 of table 2 (not shown). Furthermore, as shown in FIGS. 1 and 3, tubing 7 may extend away from clamps 3 in a distal direction that is substantially perpendicular to end 5 of table 2 as shown by angle 12. Tubing 7 may extend away from clamps 3 in a distal direction that substantially 120 degrees with respect to end 5 of table 2 as shown by angle 13. In other embodiments of the subject invention, tubing 7 may extend away from clamps 3 in a distal direction that is substantially 91 to 160 degrees or any combination thereof with respect to end 5 of table 2.

In one embodiment of the subject invention, tubing 7 may be comprised of plastic materials, metal, wood, or a firm foam material. In other embodiments of the subject invention, tubing 7 may be 4" to 30" in length and ½" to 3" in diameter. In another embodiment of the subject invention, additional tubing (not shown) may be connected to the distal end 14 of tubing 7 to give greater depth to netting system 1. In additional embodiments of the subject invention tubing 7 may have an internal lumen. In other embodiments of the subject invention, tubing 7 may comprise a traverse cross section comprising a shape selected from the group consisting of circular, triangular, square, hexagonal and octagonal. In a further embodiment of the subject invention, each individual tubing 7 and clamp 3 may comprise a single unitary piece of material, such as plastic, metal, wood, or a firm foam material.

The distal end 14 of tubing 7 is attached to the proximal end 16 of elbows 15 by insertion of the distal end 14 of tubing 7 into a proximal end lumen of each elbow 15. As shown in FIG. 2, the proximal end 16 of elbows 15 extends away from tubing 7 in a distal direction that is substantially parallel with top 10 of table 2 and contains a bend portion 17 that extends away from tubing 7 is a distal direction that is substantially perpendicular with the top 10 of table 2 as shown by angle 18. In other embodiments of the subject invention, bend portion 17 may extend in a distal direction that is 30 to 160 degrees in relation to the top 10 of table 2 (not shown). In one embodiment of the subject invention, elbows 15 may be comprised of plastic material, metal, wood, or a firm foam material. In other embodiments of the subject invention, elbows 15 may be 2" to 20" in length and ½" to 3" in diameter. In another embodiment of the subject invention, additional tubing (not shown) may be connected to the distal end 19 of elbows 15 to give greater height to netting system 1. In other embodiments of the subject invention, elbows 15 may comprise a traverse cross section comprising a shape selected from the group consisting of circular, triangular, square, hexagonal and octagonal.

In one embodiment of the subject invention inserts 20 may be inserted into a distal end lumen of elbows 15. These inserts may extend in a distal direction that is 30 to 160 degrees in relation to the top 10 of table 2 (not shown). In one embodiment of the subject invention, inserts 20 may be comprised of plastic material, metal, wood, or a firm foam material.

In a further embodiment of the subject invention, each individual tubing 7, elbow 15 and insert 20 may comprise a single unitary piece of material, such as plastic, metal, wood, or a firm foam material.

A netting 21 is attached over tubing 7, elbows 15 and inserts 20 with ties 9. In one embodiment of the subject invention, netting 21 and/or ties 9 may be comprised of a fabric material, a vinyl polymer, a plastic material.

In another embodiment of the subject invention, netting 21, tubing 7, elbows 15 and inserts 20 may be attached by adhesives in a pre-fabricated kit.

The netting is placed on either side of table 2 behind the cup formations. Opposing teams play the game behind the distal end of each netting system 1. Thrown or paddled ping pong balls that go over table top surface 10 will land in netting 21, preventing these balls from touching the dirty surrounding floor. Accordingly, the balls will transmit much less dirt and bacteria to beverages contacted and consumed during the remaining game play.

In other embodiments of the subject invention, indicia such as pictures, logos, colors, cartoon images, photographic images, game images or advertisements may be imprinted onto netting 21, ties 9, tubing 7, clamps 3 and elbows 15.

What is claimed is:

1. An accessory for use with a beer pong table having a substantially horizontal playing surface, wherein the accessory comprises: a first mounting base constructed and arranged to be detachably mounted to a first latitudinal side edge of the playing surface of the beer pong table, wherein the first mounting base extends outward in a substantially perpendicular direction from the first latitudinal side edge; a first set of at least two elongated resilient rod members; a first means for attaching proximal ends of the first set of rod members to the first mounting base such that the first set of rod members extend outward from the first latitudinal side edge; a first elongated net removably mounted to the first set of rod members, wherein the first elongated net is dimensioned to extend the width of the first latitudinal side edge, further wherein the plurality of openings in the first elongated net are dimensioned to catch and hold 38 to 40 mm diameter table tennis balls; a second mounting base constructed and arranged to be detachably mounted to a second latitudinal side edge of the playing surface of the beer pong table, wherein the second mounting base extends outward in a substantially perpendicular direction from the second latitudinal side edge; a second set of at least two elongated resilient rod members; a second means for attaching proximal ends of the second set of rod members to the second mounting base such that the second set of rod members extend outward from the second latitudinal side edge; and a second elongated net removably mounted to the second set of rod members, wherein the second elongated net is dimensioned to extend the width of the second latitudinal side edge, further wherein the plurality of openings in the second elongated net are dimensioned to catch and hold 38 to 40 mm diameter table tennis balls.

2. The accessory of claim 1, further comprising a first set of hollow tubular elbows that comprise at least one opening for receiving the distal ends of each of the first set of rod members, and a second set of hollow tubular elbows that comprise at least one opening for receiving the distal ends of each of the second set of rod members.

3. The accessory of claim 2, further comprising a first set of tubular inserts that are inserted into a second opening on the first set of hollow tubular elbows and a second set of tubular inserts that are inserted into a second opening on the second set of hollow tubular elbows.

4. The accessory of claim 1, wherein the first Means of attaching the first mounting base member to the first set of rod members and the second means of attaching the second mounting base member to the second set of rod members is a plurality of openings in the first and second base members that receive the proximal ends of each rod member.

5. The accessory of claim 1, wherein the first and second set of rod members extend outward in a direction that is 1 to 30 degrees with respect to the horizontal playing surface of the beer pong table.

6. The accessory of claim 1, wherein the first set of Rod members extend outward in a direction that is 90 to 160 degrees with respect to the first latitudinal side edge.

7. The accessory of claim 1, wherein the second set of Rod members extend outward in a direction that is 90 to 160 degrees with respect to the second latitudinal side edge.

8. The accessory of claim 1, wherein the first mounting base is a first plurality of clamps and the second mounting base is a second plurality of clamps.

9. The accessory of claim 1, wherein the first and second mounting bases are each a plurality of clamps selected from the group consisting of magnetic clamps, squeeze clamps, bench clamps, C clamps, screw clamps, spring clamps, quick grip clamps and quick action clamps.

10. The accessory of claim 1, wherein the first mounting base and the first set of rod members are composed of a unitary piece of material.

11. The accessory of claim 1, wherein the second mounting base and the second set of rod members are composed of a unitary piece of material.

12. The accessory of claim 1, wherein the first and second set of rod members may be 4 to 30 inches in length.

13. The accessory of claim 1, wherein the means for mounting the first elongated net to the first set of rod members is flexible ties.

14. The accessory of claim 1, wherein the means for mounting the second elongated net to the second set of rod members is flexible ties.

15. The accessory of claim 1, wherein the first elongated net is mounted to first set of rod members with adhesive.

16. The accessory of claim 1, wherein the second elongated net is mounted to second set of rod members with adhesive.

17. The accessory of claim 1, wherein the first and second elongated nets may comprise a material selected from the group consisting of a fabric material, a vinyl polymer and a plastic.

18. The accessory of claim 3, wherein the first elongated net is also mounted over the first set of hollow tubular elbows and the first set of tubular inserts.

19. The accessory of claim 3, wherein the second elongated net is also mounted over the second set of hollow tubular elbows and the second set of tubular inserts.

20. The accessory of claim 2, wherein the distal end of the first and second hollow tubular elbows extend outward in a direction that is substantially perpendicular with the horizontal playing surface of the beer pong table.

* * * * *